United States Patent [19]

Ohtake et al.

[11] Patent Number: 5,039,918

[45] Date of Patent: Aug. 13, 1991

[54] ELECTRODELESS MICROWAVE-GENERATED RADIATION APPARATUS

[75] Inventors: Kohei Ohtake; Kaoru Mitsuka, both of Kawagoe; Kingo Hasebe, Hasuda; Satoshi Hayafune, Kawaguchi; Yoshitaka Kawahara, Saga; Masami Togasaki, Yokohama, all of Japan

[73] Assignees: New Japan Radio Co., Ltd.; Ushio Inc., both of Tokyo, Japan

[21] Appl. No.: 505,748

[22] Filed: Apr. 6, 1990

[51] Int. Cl.[5] ..... H05B 41/24

[52] U.S. Cl. ..... 315/248; 315/39

[58] Field of Search ..... 315/39, 248, 111.01; 313/486; 350/1.6; 250/461.1

[56] References Cited

U.S. PATENT DOCUMENTS

| | | | |
|---|---|---|---|
| 3,872,349 | 3/1975 | Spero | 315/39 |
| 3,911,318 | 10/1975 | Spero et al. . | |
| 3,987,331 | 10/1976 | Schreurs | 313/486 |
| 4,041,352 | 8/1977 | McNeill | 315/248 |
| 4,042,850 | 8/1977 | Ury | 315/39 |
| 4,359,668 | 11/1982 | Ury | 315/248 |
| 4,431,947 | 2/1984 | Ferriss | 315/248 |
| 4,504,768 | 3/1985 | Ury | 315/248 |
| 4,532,427 | 7/1985 | Matthews | 315/248 |
| 4,633,140 | 12/1986 | Lynch | 315/248 |
| 4,928,040 | 5/1990 | Uesaki | 315/39 |

FOREIGN PATENT DOCUMENTS 1371098 10/1974 United Kingdom .

OTHER PUBLICATIONS

Journal of the Illuminating Engineering Society, vol. 14, No. 1, Oct. 1984, New York, pp. 283-297; Kenji Yoshizawa.

*Primary Examiner*—Eugene R. LaRoche
*Assistant Examiner*—Amir Zarabian
*Attorney, Agent, or Firm*—Armstrong, Nikaido, Marmelstein, Kubovcik, & Murray

[57] ABSTRACT

An electrodeless microwave-generated radiation apparatus includes a microwave cavity wall made of metal material defining a microwave cavity, a lamp arranged in the microwave cavity containing emission material, a microwave generator supplying microwaves for exciting the emission material in the lamp, a microwave-coupling means coupling microwaves to the lamp through a waveguide, and a dielectric mirror arranged behind the lamp. The rise time of the apparatus can be remarkably shortened compared with the known art so that the damage of a magnetron can be reduced. The intensity of emission along the lamp is controlled by a projection or parasitic element. Further, by the use of a dielectric mirror, the object can be processed without temperature of the object to rise too high.

6 Claims, 11 Drawing Sheets

PRIOR ART FIG. 8a
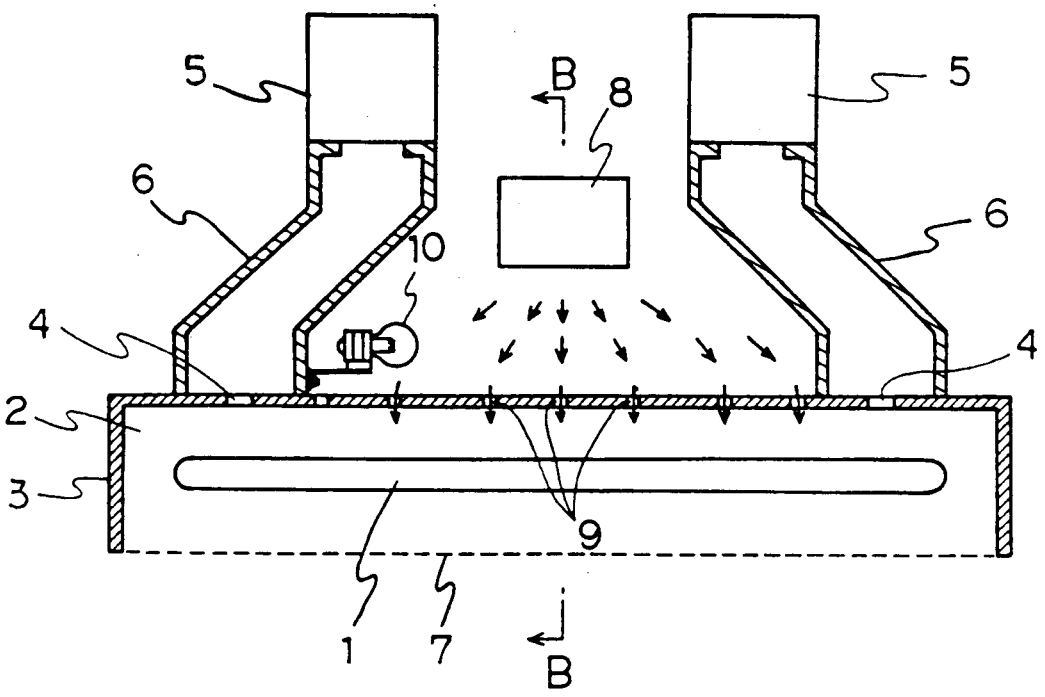
PRIOR ART
FIG. 8b
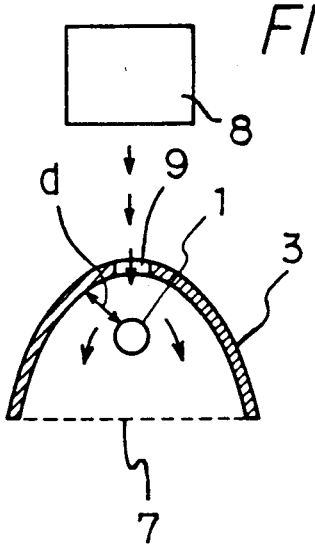

ELECTRODELESS MICROWAVE-GENERATED RADIATION APPARATUS

BACKGROUND OF THE INVENTION

The present invention relates to an electrodeless microwave-generated radiation apparatus for exciting a lamp containing emission material such as mercury by the use of microwave energy to emit radiation in the ultraviolet portion of the spectrum.

In recent years, ultraviolet radiation has been widely used for carrying out painted surface processes such as curing of ultraviolet-cured-type adhesive or ink, or photochemical reaction of chemical materials, and the like. As an apparatus for emitting such ultraviolet radiation, there has been used an electrodeless microwave-generated radiation apparatus wherein a lamp containing emission material such as mercury is excited by the use of microwave energy to emit ultraviolet radiation. Improvement in the radiation apparatus has been made and disclosed in, for example, U.S. Pat. No. 3,872,349, U.S. Pat. No. 4,042,850, U.S. Pat. No. 4,359,668 and U.S. Pat. No. 4,504,768. This kind of electrodeless radiation apparatus is shown in FIGS. 8*a* and 8*b*, in which FIG. 8*a* is a longitudinal sectional view of the apparatus and FIG. 8*b* is a sectional view taken along the line B—B of FIG. 8*a*. As shown in FIGS. 8*a* and 8*b*, there are provided in the apparatus a lamp 1, a microwave cavity 2, a reflector 3 made of metal material to define the microwave cavity and having a concave or elliptical shape in cross section for converging emitted radiations in a radiating direction, and slots 4 as coupler means for supplying microwaves generated by magnetrons 5 (microwave generators) to the microwave cavity 2 via waveguides 6. Also, there is provided a mesh 7 defining a wall of the microwave cavity 2 for transmitting emitted ultraviolet radiation. The mesh 7 acts as a short-circuit plate for microwaves while it acts as a transmitting medium for light. Numeral 8 is a blower for controlling the heat generated by electrical discharge, and more particularly for cooling down both lamp 1 and reflector 3 with air flow through vent-holes 9 provided in the reflector 3. Numeral 10 is an ultraviolet radiation bulb which serves as a source of ultraviolet radiation for initial ionization in order to trigger the formation of plasma in the lamp 1 when microwaves are introduced into the microwave cavity 2.

In the above-mentioned apparatus, when the magnetrons 5 are operated and microwave energy generated thereby is coupled to the microwave cavity 2 through the slots 4, microwave energy excite emission material such as mercury vapor contained in the lamp 1. Ultraviolet radiation from the ultraviolet radiation bulb 10 triggers electrical discharge in the lamp 1 to emit ultraviolet radiation. The lamp 1 is located at a focal point of the elliptically surfaced reflector 3 and thus, while a portion of the radiations emitted in all directions is directly transmitted through the mesh 7, the remaining radiations emitted in the opposite direction (upward direction) and lateral direction are reflected on the reflector 3 and advance towards the mesh 7. Therefore, an object to be processed will instantly be processed (e.g. dried and cured) when disposed beneath the mesh 7. A large number of objects can be processed continuously if they are moved successively by a belt conveyor or the like.

In the electrodeless radiation apparatus, mercury which is likely to emit ultraviolet radiation is contained in the lamp 1 since the apparatus aims at processing objects by ultraviolet radiation. The generation of visible radiation and infrared radiation besides ultraviolet radiation is, however, inevitable so that the temperature of the lamp 1 under operation becomes considerably high. Thus, in order to protect the lamp 1 from being damaged at a high temperature and avoid overheat of the reflector 3 and objects to be processed, air is supplied inside the microwave cavity 2 by the blower 8 through the vent-holes 9 provided in the reflector 3 to cool the lamp 1.

In the conventional apparatus having the abovementioned structure, microwaves supplied into the microwave cavity 2 are repeatedly reflected in the microwave cavity 2 at random and not properly converged on the lamp 1, so that it takes more than several tens seconds till emission of ultraviolet radiation becomes stable. Thus, the conventional apparatus has a drawback that harmful ozone gas generates or reflected microwave damages the magnetron till emission of ultraviolet radiation becomes stable. In addition, objects to be processed are overheated due to infrared radiation or visible radiation.

The present invention was made to solve the above drawbacks, and it is an object of the present invention to provide an electrodeless radiation apparatus which can effectively couple microwave energy to a lamp so that the time required for stabilization of the emission of ultraviolet radiation is shortened, and which can reduce undesirable radiation such as infrared radiation.

SUMMARY OF THE INVENTION

In the apparatus of the present invention, a cavity wall defining a microwave cavity and a reflector reflecting radiation are made of other material from each other, and reflector comprises a mirror made of dielectric materials which reflects ultraviolet radiation while transmitting infrared radiation. Further, heat absorbing coating for absorbing infrared radiation and a part of visible radiation is applied to the inner surface of the cavity wall as occasion demands, whereby reducing heat radiation toward objects t be processed to the utmost.

Another means of the present invention is that, in the above electrodeless microwave-generated radiation apparatus wherein a microwave cavity wall and a reflector are made of other material from each other, the microwave cavity wall along a longitudinal direction of a lamp is protruded toward the lamp to form a convex portion.

A further means of the present invention is a microwave-coupling means comprising a couple of antennas arranged on both sides of and parallel to the lamp, each of which antennas is coupled at one end to a coaxial converter in the waveguide and at the other end to the waveguide or microwave cavity wall.

A still further means of the present invention is, in the electrodeless microwave-generated radiation apparatus having the microwave-coupling mean, a projection or parasitic element provided on the inner wall of the microwave cavity adjacent to the center of the lamp in order to prevent decrease in emission of ultraviolet radiation at the central area of the lamp.

Another means of the present invention is a means for controlling flow of cooling air on detecting temperature of the glass surface of the lamp with an infrared radiation thermal sensor so that the rise time of the lamp can be minimized.

According to the present invention, microwave energy can be coupled to the lamp with high efficiency so that the lamp begins to emit ultraviolet radiation in a short period of time. Also, the undesirable radiation such as infrated radiation can be reduced to a minimum, thus allowing desirable ultraviolet radiation to be irradiated on an object to be processed.

BRIEF EXPLANATION OF THE DRAWINGS

FIG. 8*a* is a schematic longitudinal sectional view of a conventional prior art electrodeless microwave-generated radiation apparatus; and FIG. 8*b* is a sectional view taken elong the line B—B of FIG. 8*a*.

DETAILED DESCRIPTION

Next, an electrodeless microwave-generated radiation apparatus of the present invention is explained based on the accompanying drawings.

Figure 1A:
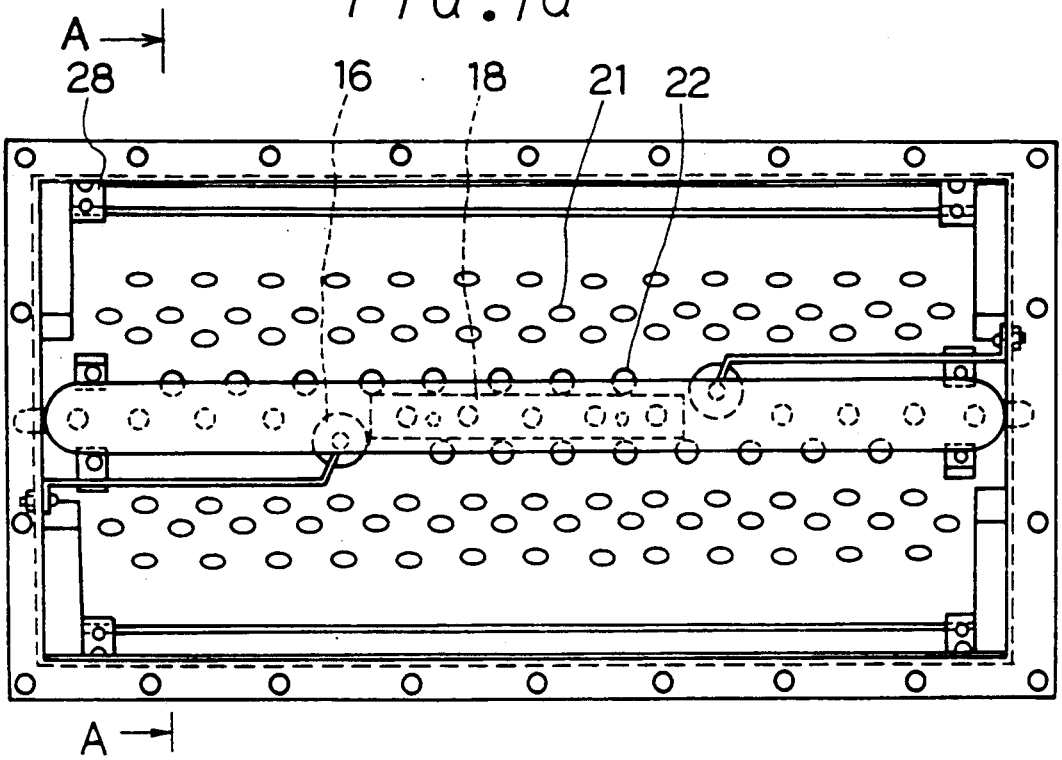
FIG. 1*a* is a detailed view from the incident side of a radiation portion of an embodiment of an electrodeless microwave-generated radiation apparatus of the present invention.
Figure 1B:
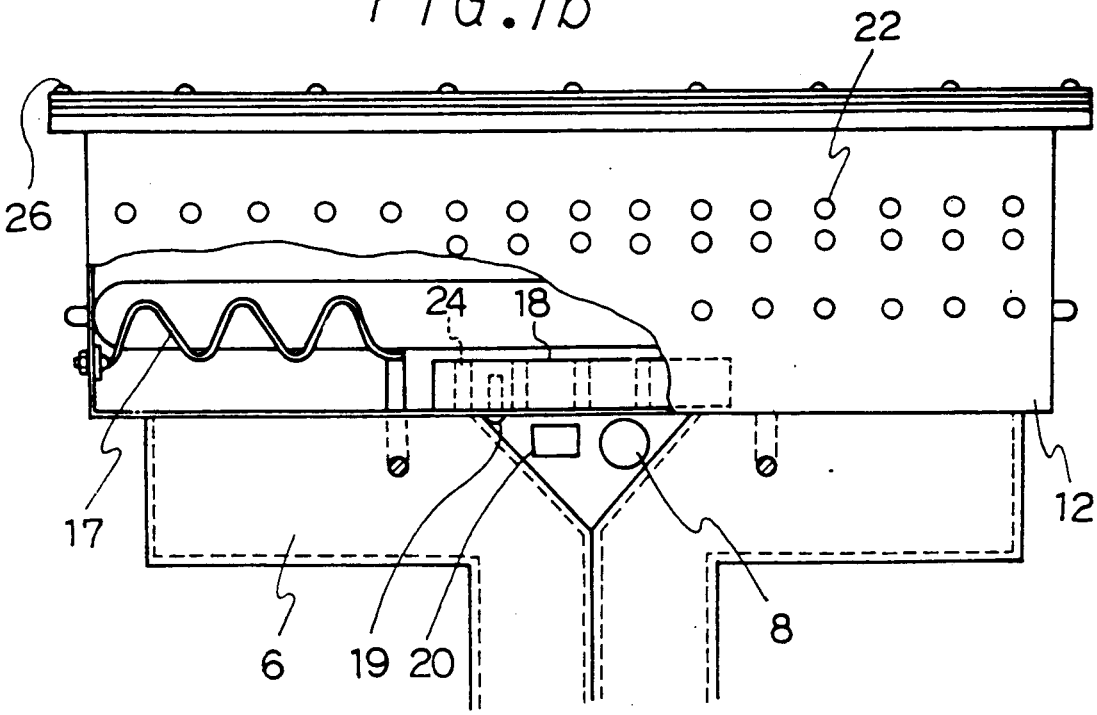
FIG. 1*b* is a partially cutaway front view of the embodiment of FIG. 1*a;*
Figure 1C:
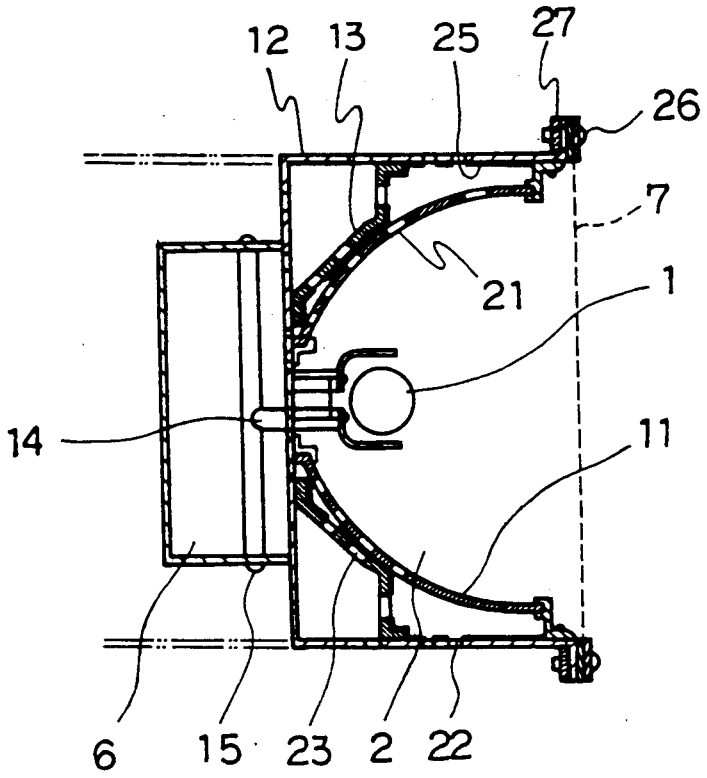
FIG. 1*c* is a sectional view taken along the line A—A of FIG. 1*a;*

In the embodiment shown in FIGS. 1*a* to 1*c*, microwave energy generated by a microwave generator (not shown) is supplied to a microwave cavity 2 through a waveguide 6 to make emission materials in a lamp 1 discharge and emit ultraviolet radiation. While keeping the lamp 1 cool by the air fed through vent-holes from a blower 8 to avoid damage of the lamp 1 by heat, ultraviolet radiation produced is irradiated through a mesh 7 partly defining the microwave cavity to objects to be processed. This structure or function is the same as the conventional apparatus.

A first feature of the embodiment is that a microwave cavity wall is structurally separated from a reflector, and that the reflector comprises a dielectric mirror 11 while the microwave cavity wall comprises a part of a housing, a cavity wall 13 made of metal sheet or plate inside the housing, and a mesh 7.

Figure 2:
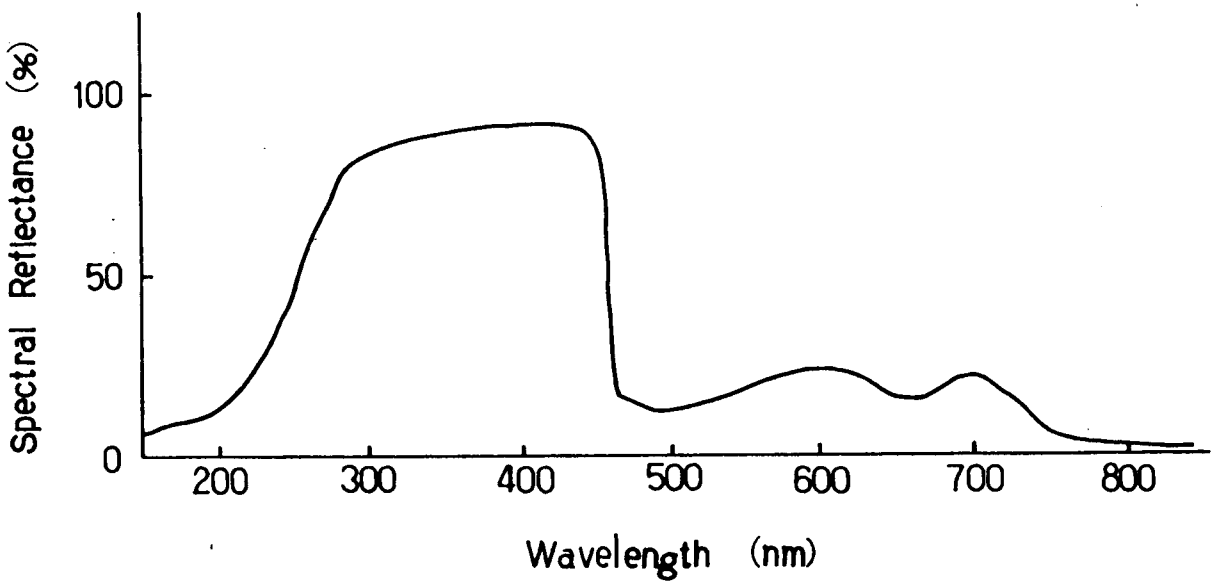
FIG. 2 is a view showing reflectance of a dielectric mirror according to an embodiment to wavelength.

The dielectric mirror 11 comprises a pair of symmetrical mirrors joined at center to each other. Each mirror comprises, for example, Fused Silica glass or Bolosilicate glass available from CORNING GLASS WORKS under the commercial name "Pyrex" of 2 mm in thickness whereon deposition films made of dielectric material such as metal oxide are formed in several or several tens of layers. Thus, the dielectric mirror 11 can reflect desirable ultraviolet radiation while transmitting infrared or visible radiation as shown in FIG. 2 in which the relationship between reflectance and wavelength of radiation is illustrated.

Figure 3A:
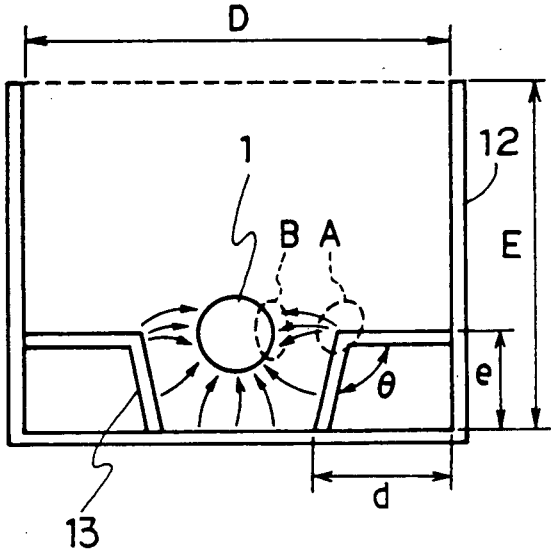
FIG. 3*a* is a schematic view explaining effect of a convex portion of a cavity wall.
Figure 3B:
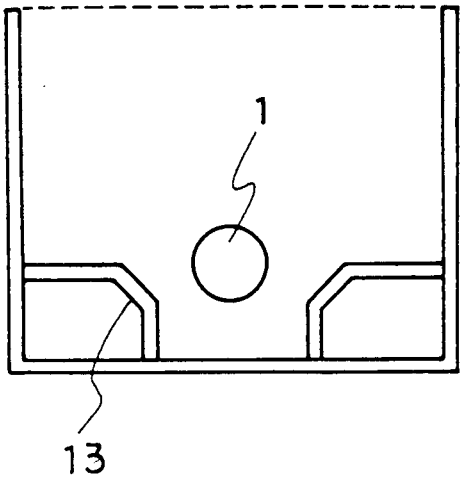
FIG. 3*b* and FIG. 3*c* are views showing shape of other embodiments of the cavity wall in the present invention.
Figure 3C:
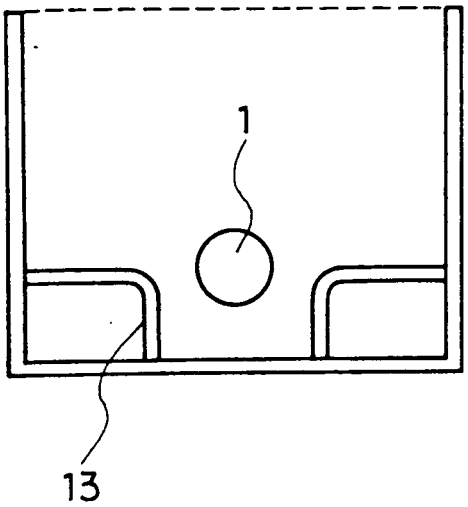
Figure 3D:
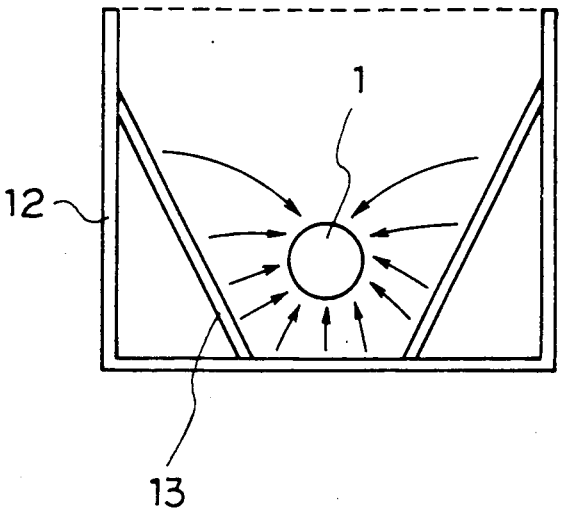
FIG. 3*d* is a view of the conventional cavity wall without a convex portion.
Figure 4A:
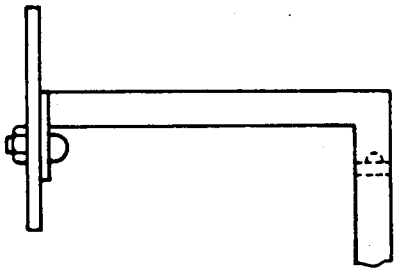
FIG. 4*a* to FIG. 4*e* are views showing other embodiments of the antenna in the present invention.
Figure 4B:
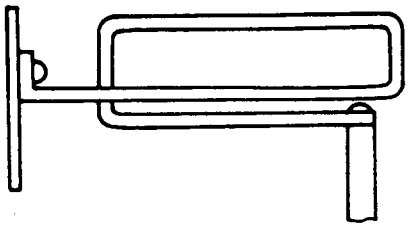
Figure 4C:
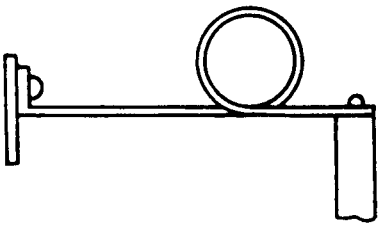
Figure 4D:
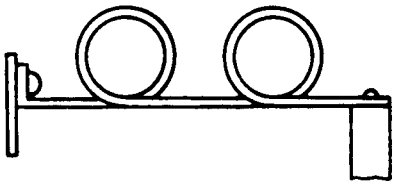
Figure 4E:
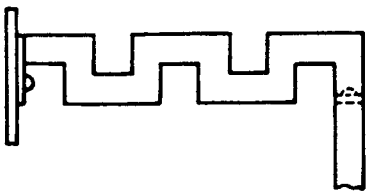

A cavity wall 13 is so formed as to protrude toward the lamp 1 as shown in FIG. 1*c*. Such shape enables the concentration of an electric field on the lamp, thereby shortening rise a time of emission. That is, electric lines of force are concentrated on a convex portion A (folded portion) of the cavity wall 13 as shown in FIG. 3*a*, so that the density of electric lines of force on the portion B of the lamp 1 facing the convex portion A is raised and electric field on the portion B is enhanced. Accordingly, excitation of plasma is intensively encouraged as compared with a known microwave cavity wall which serves as a housing or a planar microwave wall as shown in FIG. 3*d*. The dimension e of the cavity wall 13 might be so designed as to be approximately equal to the level of the central axis of the lamp 1. The dimensions e, d and $\theta$ have relation to the dimensions D and E of the housing 12, the location or diameter of the lamp 1, and the shape of the dielectric mirror 11, and accordingly can be determined through experiments. The convex portion of the cavity wall 13 is not limited to an edged form and might be shaped as shown in FIGS. 3*b* and 3*c*.

A second feature of the embodiment is that a microwave-coupling means for feeding microwaves from waveguides 6 into the microwave cavity 2 comprises a wave-shaped antenna 17 closely disposed on both sides of and parallel to the lamp 1. One end of the antenna 17 is connected to the end of a coaxial converter 14 while the other end thereof is connected to the housing 12. The coaxial converter 14 is located within the waveguide 6 by means of a screw 15 and extends into the microwave cavity 2 through a coupler opening 16 provided on the housing 12. One end of the antenna 17 is connected to an end of the extended coaxial converter 14. The antenna 17 enables the concentration of electric field of microwave in the lamp 1, whereby promoting electrical discharging and emission of emission material contained in the lamp 1.

The antenna 17 has a wave-shaped configuration to increase the surface area and to make microwave electric field be coupled into the lamp 1 as much as possible. The antenna 17 might be formed into a plate-like shape or other shapes shown in FIG. 4.

Figure 1D:
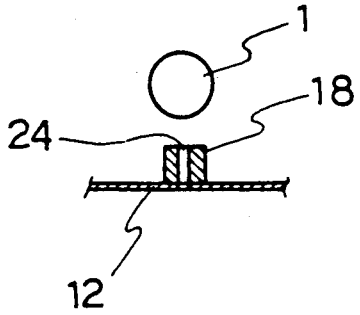
FIG. 1*d* is a partially enlarged view of a projection in the apparatus of the present invention.

A third feature of the present embodiment is that a projection 18 is attached by screws 19 to the housing 12 beneath the center of the lamp 1 as shown in FIG. 1*d*. When using the above microwave-coupling means, the emission is sometimes weak near central portion of the lamp 1 while it is strong at both ends of the lamp 1 due to a relatively strong electric field by the antenna 17. In such case, the projection 18 serves to carry out uniform discharging and emission in the lamp 1.

Figure 5A:
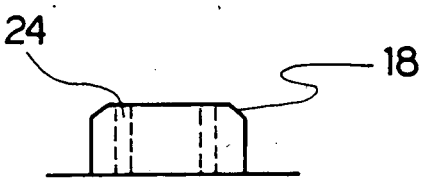
FIG. 5*a* to FIG. 5*c* are views showing shape of other embodiments of the projection in the present invention.
Figure 5B:
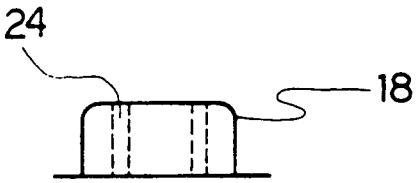
Figure 5C:
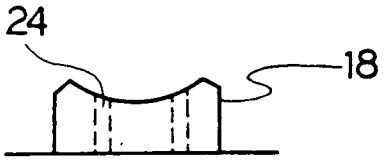
Figure 5D:
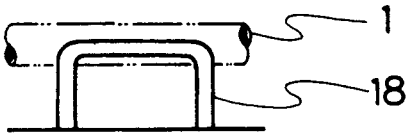
FIG. 5*d* to FIG. 5*g* are views showing examples of a parasitic element in the present invention.
Figure 5E:
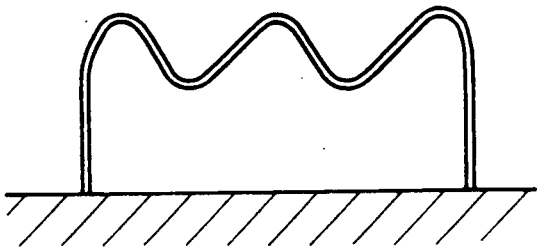
Figure 5F:
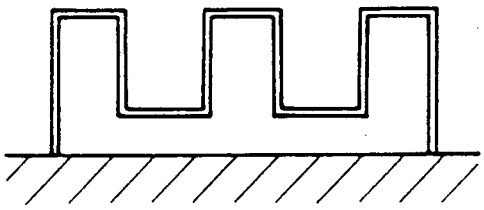
Figure 5G:
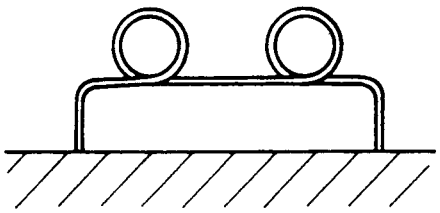

The projection in the present invention is not limited to one shown in FIG. 1*d*, and any means is employable so long as it can effectively concentrate electric field on the lamp 1. For example, a projection of another shape shown in FIG. 5*a*, FIG. 5*b*, or FIG. 5*c*, in which a corner portion is rounded off to prevent excessive convergence of electric lines of force, might be employed. Further, one or two parasitic elements disposed on one or both sides of the lamp 1 as shown in FIG. 5*d*, FIG. 5*e*, FIG. 5*f* or FIG. 5*g* might be employed. The parasitic element acts as a waveguide like an auxiliary antenna in an aerial system when the longitudinal length of the parasitic element is designed to be $\lambda/2$($\lambda$: wavelength of microwaves in free space), and contributes to intensifying the emission at the central area. A parasitic element having such shape as shown in FIG. 5*e*, FIG. 5*f* or FIG. 5*g* provides an desirable length within a limited range.

Figure 6A:
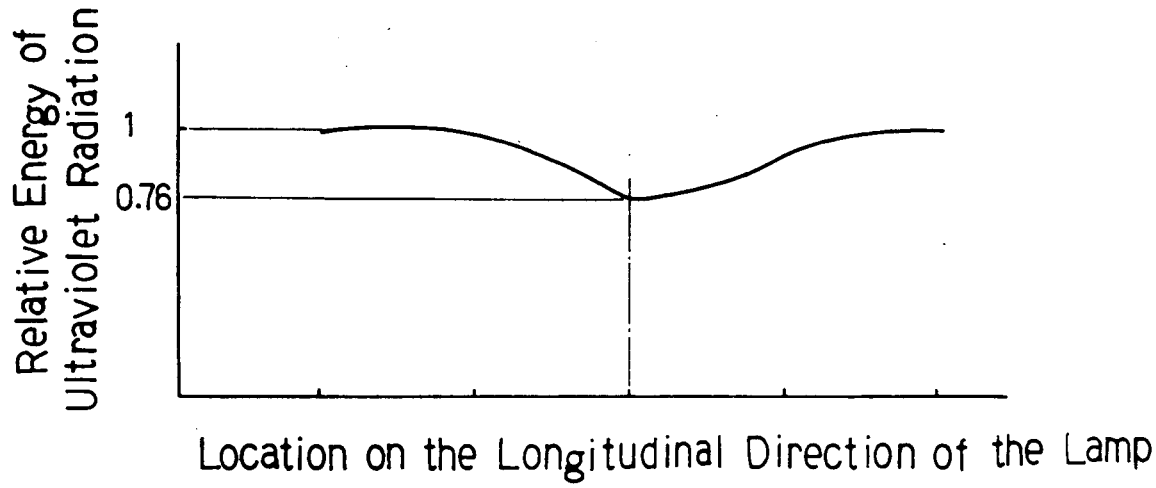
FIG. 6*a* is a view explaining the relationship between location on a lamp in its longitudinal direction and relative energy of ultraviolet radiation in which a projection is not provided on a cavity wall.
Figure 6B:
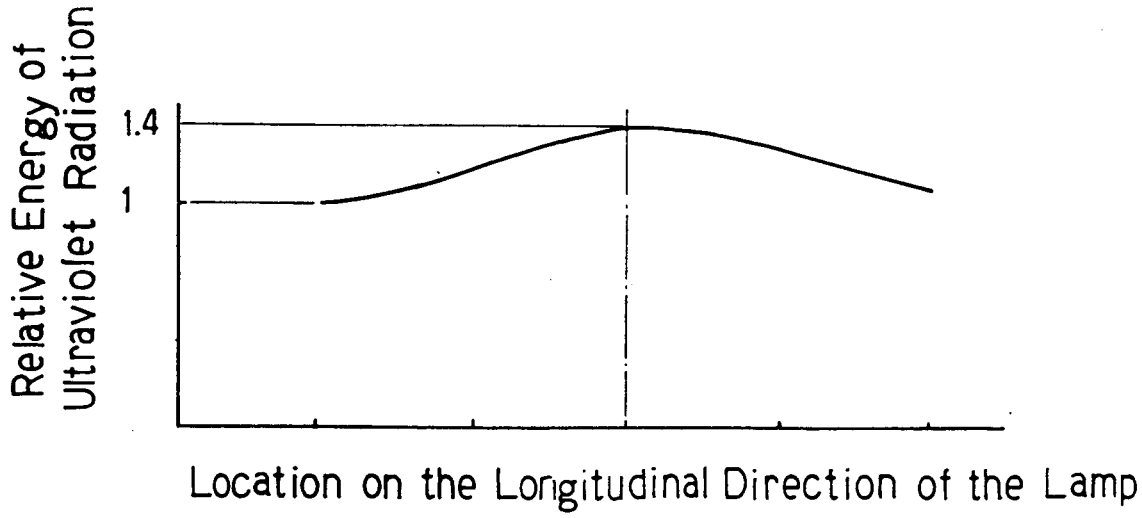
FIG. 6*b* is a view explaining the relationship between location on a lamp in its longitudinal direction and relative energy of ultraviolet radiation in which a projection is provided on a cavity wall.

The relationship between relative energy of ultraviolet radiation and the location on the lamp (total length 250 mm) in the longitudinal direction is shown in FIG. 6*a* and 6*b* in order to compare the intensity of emission at the central area of the lamp when providing a projection portion (FIG. 6*b*) to that when not providing a projection portion (FIG. 6*a*). FIG. 6*a* shows that the relative energy of ultraviolet radiation at center reduces to 76 % of that at both ends, while FIG. 6*b* shows that the relative energy of ultraviolet radiation at center is 1.4 times higher than that at both ends. The intensity of emission varies depending on location of the projection, clearance between the projection and the lamp, and the like, so that the intensity of emission at the central area can be made higher than or equal to that at both ends.

A fourth feature of the present embodiment is that an infrared radiation thermal sensor 20 is provided adjacent to the lamp 1 but outside the microwave cavity 2, in order to shorten the rise time of emission by decreasing air flow from the blower 8 when the temperature of the lamp 1 is low before emission. The lamp 1 is cooled down with air from the blower 8 through vent-holes 21, 22, 23 and 24 provided on the dielectric mirror 11, the housing 12, the cavity wall 13, and the projection 18 respectively to prevent damage of the lamp 1 caused by overheat during emission. If the lamp 1 before the start of emission is cooled down with air like the lamp which is emitting, the temperature of the lamp 1 remains low due to overcooling so that the start of emission is delayed.

Figure 7A:
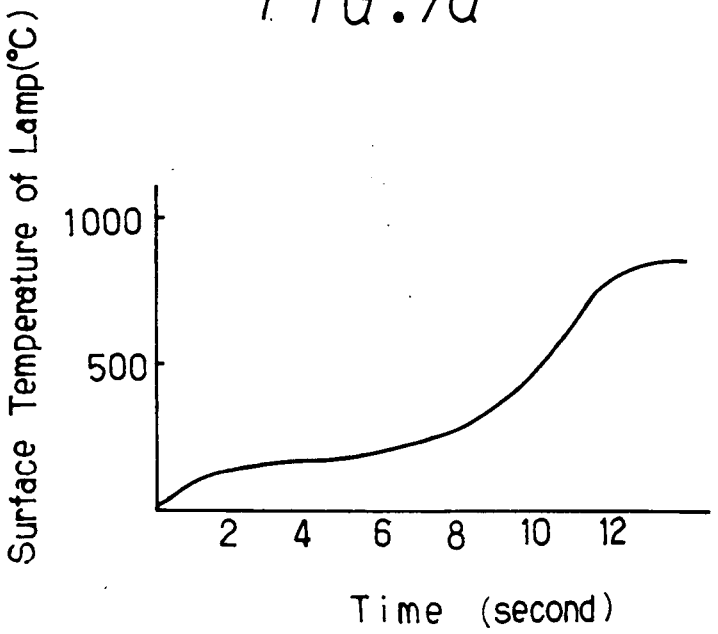
FIG. 7*a* is a view explaining the relationship between supply time of microwave energy to a microwave cavity and temperature of the lamp surface in which air flow from a blower is not controlled.
Figure 7B:
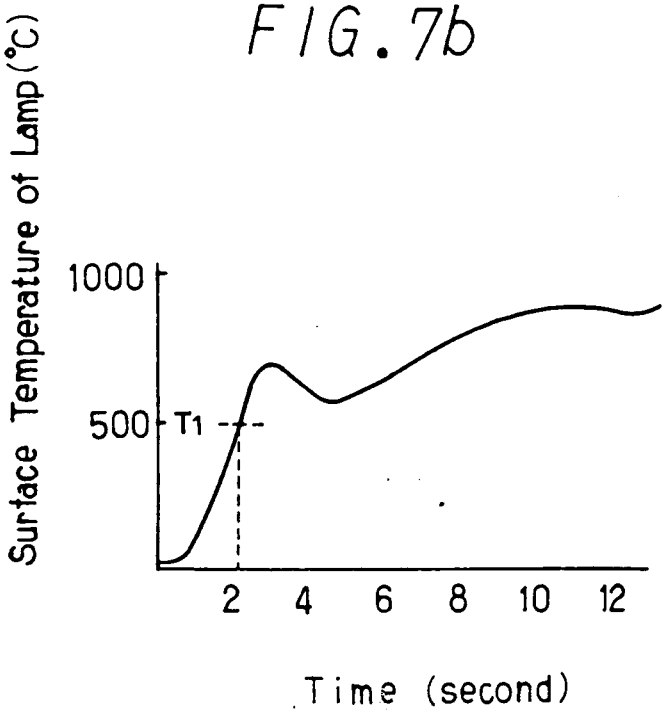
FIG. 7*b* is a view explaining the relationship between supply time of microwave energy to a microwave cavity and temperature of a lamp surface in which air flow from a blower is controlled as shown in FIG. 7*e*
Figure 7C:
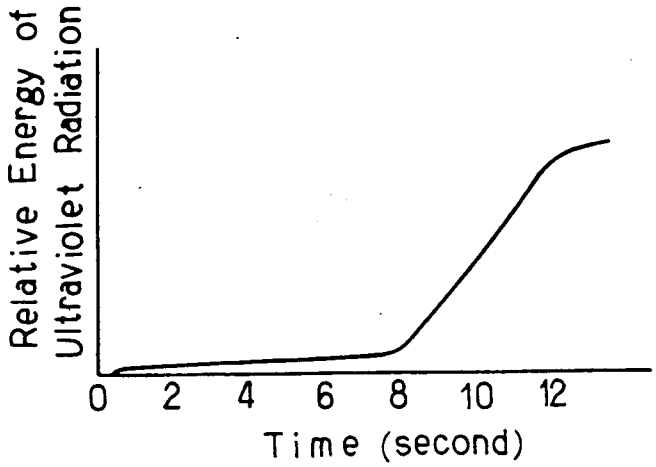
FIG. 7*c* is a view explaining the relationship between supply time of microwave energy to a microwave cavity and relative energy of ultraviolet radiation in which air flow from a blower is not controlled.
Figure 7D:
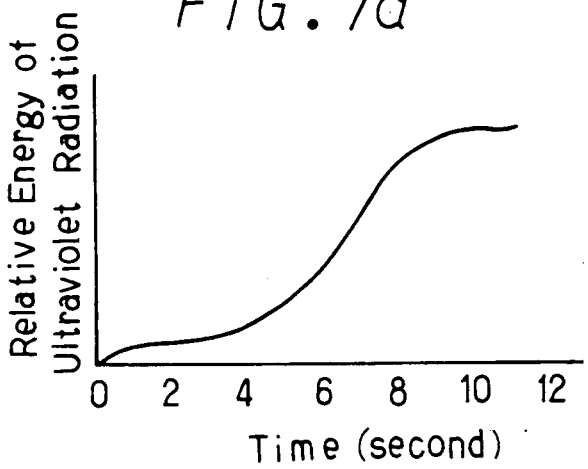
FIG. 7*d* is a view explaining the relationship between supply time of microwave energy to a microwave cavity and relative energy of ultraviolet radiation in which air flow from a blower is controlled as shown in FIG. 7*e;*
Figure 7E:
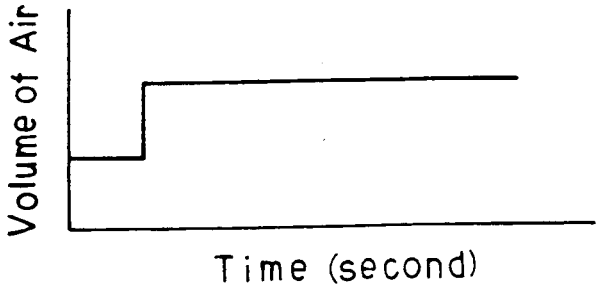
FIG. 7*e* is a view showing the controlling of air flow.

FIG. 7*a* to 7*d* show relationship between supply time of microwave energy and temperature of the lamp 1 or relative energy of ultraviolet radiation produced. More particularly, FIGS. 7*a* and 7*c* show relationship between supply time of microwave energy and temperature of the lamp surface (FIG. 7*a*) or relative energy of ultraviolet radiation (FIG. 7*c*) in which air flow from the blower is constant from the start of microwave energy supply, and FIGS. 7*b* and 7*d* show relationship between supply time of microwave energy and temperature of the lamp surface (FIG. 7*b*) or relative energy of ultraviolet radiation (FIG. 7*d*) in which air flow from the blower is so controlled as to be half of the usual air flow till the temperature of the lamp 1 rises to 500° C. as shown in FIG. 7*e*. As is clear from FIGS. 7*a* to 7*d*, it takes about twelve seconds to emit sufficient amount of ultraviolet radiation when air flow is not controlled, while such rise time can be shortened to about eight seconds by controlling air flow.

The use of the infrared radiation thermal sensor 20 detecting wavelength of not less than 3 μm can avoid the influence of plasma and ultraviolet radiation in the lamp 1, so that the temperature of the glass surface of the lamp 1 can be accurately detected. The infrared radiation thermal sensor 20 might be made of InSb. The air flow can be controlled by varying the direction of a air-flow-variable plate mounted on the blower 8 by means of a motor driven by a signal from the infrared radiation thermal sensor 20 through a control circuit.

In the present embodiment, the microwave cavity and the reflector wall are made of materials which are different from each other, so that the reflector wall of the mirror 11 can be made of specific material to form a dielectric mirror as started above, whereby enabling reflection of desirable ultraviolet radiation while enabling transmission of undesirable infrared radiation and visible radiation. Accordingly, if heat-absorbing coating 25 is applied to an inner wall of the cavity wall 13 or housing 12 behind the dielectric mirror 11, the increase of temperature of objects to be processed can be avoided since the inner wall absorbs transmitted heat rays without reflecting the same, so that ultraviolet radiation curing of the objects to be processed, a temperature of which should not be raised, can be preferably carried out.

In the above-mentioned embodiment, the mesh 7 defining a part of the microwave cavity is connected to the housing 12 by means of a screw 26 attached to the housing 12 and a tapping plate 27, and the dielectric mirror 11 is fixed to a supporting means 28 attached to the housing 12. The connecting or fixing method is not limited in the present invention, and other method can be employable. Further, a wall defining a microwave cavity can be integrated with a housing, i.e. the microwave cavity can be defined by a part of the housing, though a microwave cavity wall 13 is attached to the inner wall of the housing 12 in the above embodiment.

As is explained hereinafter, according to the present invention, the time from the start of supply of microwave energy to the start of discharging and emission of the lamp can be remarkably shortened. That is, the rise time of thirty seconds in the case of conventional apparatus can be shortened to about five or six seconds by employing the above-mentioned several means. In result, the influence of reflected microwave energy on a magnetron can be significantly reduced whereby lengthening life time of the magnetron. That is, in the conventional apparatus, microwave energy supplied into the microwave cavity is not effectively used and reflected to a magnetron (microwave generator) till the discharging in the lamp starts to emit ultraviolet radiation, whereby giving undesirable influence on the life time of the magnetron. On the contrary, the rise time is remarkably shortened so that the harm caused by the reflected microwave energy can be reduced in the apparatus of the present invention.

Further, the intensity of emission along an axial direction of the bar-shaped lamp can be controlled by a projection or parasitic element, so that the intensity of emission at the central area can be so controlled as to be equal to, or higher or lower than that at both ends of the lamp depending on the nature of objects to be processed.

Still further, a dielectric mirror, which can reflect only ultraviolet radiation while transmitting visible radiation and infrared radiation, is employable so that the apparatus gives a great effect in treating objects with ultraviolet radiation without rising the temperature of the objects too high.

What is claimed is:

1. An electrodeless microwave-generated radiation apparatus comprising:

an elongated box-shaped microwave cavity wall made of metal material defining a microwave cavity, one surface of the microwave cavity wall being made mesh-like, a bar-shaped lamp arranged in the microwave cavity along a longitudinal direction of the cavity and containing therein emission material, a microwave generator supplying microwaves for exciting the emission material in the lamp to emit radiation, a microwave-coupling means coupling microwaves from the microwave generator to the lamp through a waveguide, said microwave-coupling means comprising a coaxial converter disposed in the waveguide, and antennas disposed at both ends of and parallel to the lamp, one end of each antenna being connected to the coaxial converter and the other end of antenna being connected to a wall defining the microwave cavity, and a dielectric mirror arranged behind the lamp for concentrating radiation emitted from the lamp to the mesh of the microwave cavity.

2. The apparatus of claim 1, wherein the dielectric mirror is so constituted as to transmit visible radiation and infrared radiation while reflecting ultraviolet radiation.

3. The apparatus of claim 1, wherein heat-absorbing coating is applied to an inner surface of the microwave cavity wall behind the dielectric mirror.

4. The apparatus of claim 1, wherein a convex portion toward the lamp is formed on a part of said cavity wall defining the microwave cavity.

5. The apparatus of claim 1, wherein a projection or a parasitic element is provided on an inner surface of the microwave cavity wall near the center of the lamp.

6. The apparatus of claim 1, wherein the apparatus further including a cooling means for supplying air to the lamp, an infrared radiation sensor disposed near the lamp, and a means for controlling air flow depending on a temperature of the lamp.

* * * * *